United States Patent [19]

Arther et al.

[11] Patent Number: 4,528,050

[45] Date of Patent: Jul. 9, 1985

[54] PRODUCING FILLER MATERIAL, PARTICULARLY FOR CIGARETTE FILTERS

[75] Inventors: Hugh M. Arther, High Wycombe; Edward G. Preston, Orpington, both of England; David B. Stewart, Dundee, Scotland; Godfrey A. Wood, High Wycombe, England

[73] Assignee: Molins plc, London, England

[21] Appl. No.: 403,329

[22] Filed: Jul. 30, 1982

[30] Foreign Application Priority Data

Jul. 30, 1981 [GB] United Kingdom ..... 8123297

[51] Int. Cl.[3] ..... B32B 5/02

[52] U.S. Cl. ..... 156/62.4; 19/0.35; 19/0.58; 19/305; 83/913; 131/341; 156/296; 425/82.1

[58] Field of Search ..... 156/180, 62.2, 62.4, 156/62.8, 296, 441, 276, 279; 19/13, 0.62, 299, 302, 305, 667, 657, 0.35, 0.58, 306; 264/109, 122; 493/42, 44, 46, 47, 49, 50, 941; 83/913; 131/340, 341, 343, 344; 425/82.1, 81.1, 83.1

[56] References Cited

U.S. PATENT DOCUMENTS

| | | | |
|---|---|---|---|
| 2,774,680 | 12/1956 | Hackney et al. | 156/276 |
| 2,931,748 | 4/1960 | Muller | 493/50 |
| 3,658,626 | 4/1972 | Berger et al. | 156/62.2 |
| 3,675,541 | 7/1972 | Tokitomo et al. | 156/180 |
| 3,862,472 | 1/1975 | Norton et al. | 19/305 |
| 3,910,166 | 10/1975 | Sexstone | 493/47 |
| 3,913,176 | 10/1975 | Grossi | 19/0.35 |
| 3,918,126 | 11/1975 | Wood | 19/145.7 |
| 4,088,065 | 5/1978 | Hall | 493/941 |

*Primary Examiner*—Michael Ball

*Attorney, Agent, or Firm*—Antonelli, Terry & Wands

[57] ABSTRACT

Filler material, particularly for cigarette filters, is produced by feeding a first stream of substantially continuous filaments of filler material onto a pin roller which is driven at a speed such that the filaments are broken by the pins into irregular lengths and are projected from the roller in random orientations. The broken filaments are collected on a carrier stream, also comprising filamentary material, for delivery to a rod-making unit. More than one stream could be supplied to the pin roller so that the broken filaments can comprise a mixture of filaments of different filler materials. The carrier stream may comprise filler material which is different from that in the first stream and may comprise a fibrillated web.

24 Claims, 10 Drawing Figures

PRODUCING FILLER MATERIAL, PARTICULARLY FOR CIGARETTE FILTERS

This invention relates to apparatus for producing filler material, particularly for cigarette filters.

Cigarette filters have commonly been made from filter tow which consists of a cluster of crimped monofilaments, usually of cellulose acetate. The tow is drawn from a bale, is stretched by differential-speed rollers to separate the filaments and spread them out evenly, and is finally compressed to form a stream having the cross-section of the completed filters. A plasticiser such as triacetin is usually sprayed onto the filaments while they are spread out. The compressed stream of filaments may be enclosed in a continuous wrapper or may be set by means of steam or some other source of heat to form a continuous rod which is then cut at regular intervals.

One aspect of the present invention provides apparatus for producing filler material comprising means for conveying a substantially continuous first stream of filaments, a conveyor having a surface adapted to engage said filaments, means for driving the conveyor such that the filaments of the stream are engaged by the surface and broken into irregular lengths, means for conveying a carrier stream of filaments, and means for combining the broken filaments from said first stream with the carrier stream to form a combined stream. The combined stream may be fed to a rod-forming device in which the stream is laterally compressed and formed into a continuous rod. The conveyor surface preferably has sharp projections for engaging the filaments, and a wall may be provided defining with said conveyor a channel through which filaments on said conveyor pass, said projections extending across said channel substantially to said wall. The projections may be forwardly-inclined relative to the direction of movement of the conveyor surface. The conveyor could be a pin roller.

The combining means may include means for showering the broken filaments, and may include means for reducing the width of the stream on said band. The combining means could comprise pneumatic means, which could supply a stream directly to a rod-shaping device.

Where the apparatus used for filter production the conveying means for the first or carrier stream could be adapted to feed conventional filter tow and include means for blooming the tow or it could include means for fibrillating a web of other filter material. At least two different streams may be fed to form the first stream and so be engaged by the conveyor to produce a mixture of broken filaments. There could be a plurality of said conveyors, and a common carrier stream so that the combined stream includes broken filaments from at least two different conveyors. The carrier stream itself may comprise two or more combined streams. The first and carrier streams may, therefore, each comprise several different filter materials (from different forming streams). In any event the first and carrier streams may comprise the same or different filter materials.

Fluid additive, such as plasticiser, where required could be applied to either or both streams, e.g. in the case of the first stream, before the filaments are broken, or by the conveyor which breaks the filaments, or in the case of the carrier stream, before or after it receives the broken filaments.

The first and carrier streams may be derived from a common stream, so that said stream is divided into a stream which becomes said first stream and passes to said conveyor and a stream which becomes said carrier stream.

Another aspect of the invention provides apparatus for producing filter rod, comprising means for producing a filler stream of relatively short filaments from a first stream of filter material, means for conveying a carrier stream of relatively long filaments of a filter material, means for depositing the filler stream on the carrier stream, and means for forming continuous filter rod from the combined filler and carrier streams. Preferably the carrier stream consists of part of said first stream. Alternatively the carrier stream consists of a fibrillated web of filter material.

The invention will be further described, by way of example only, with reference to the accompanying diagrammatic drawings, in which.

Figure 1:
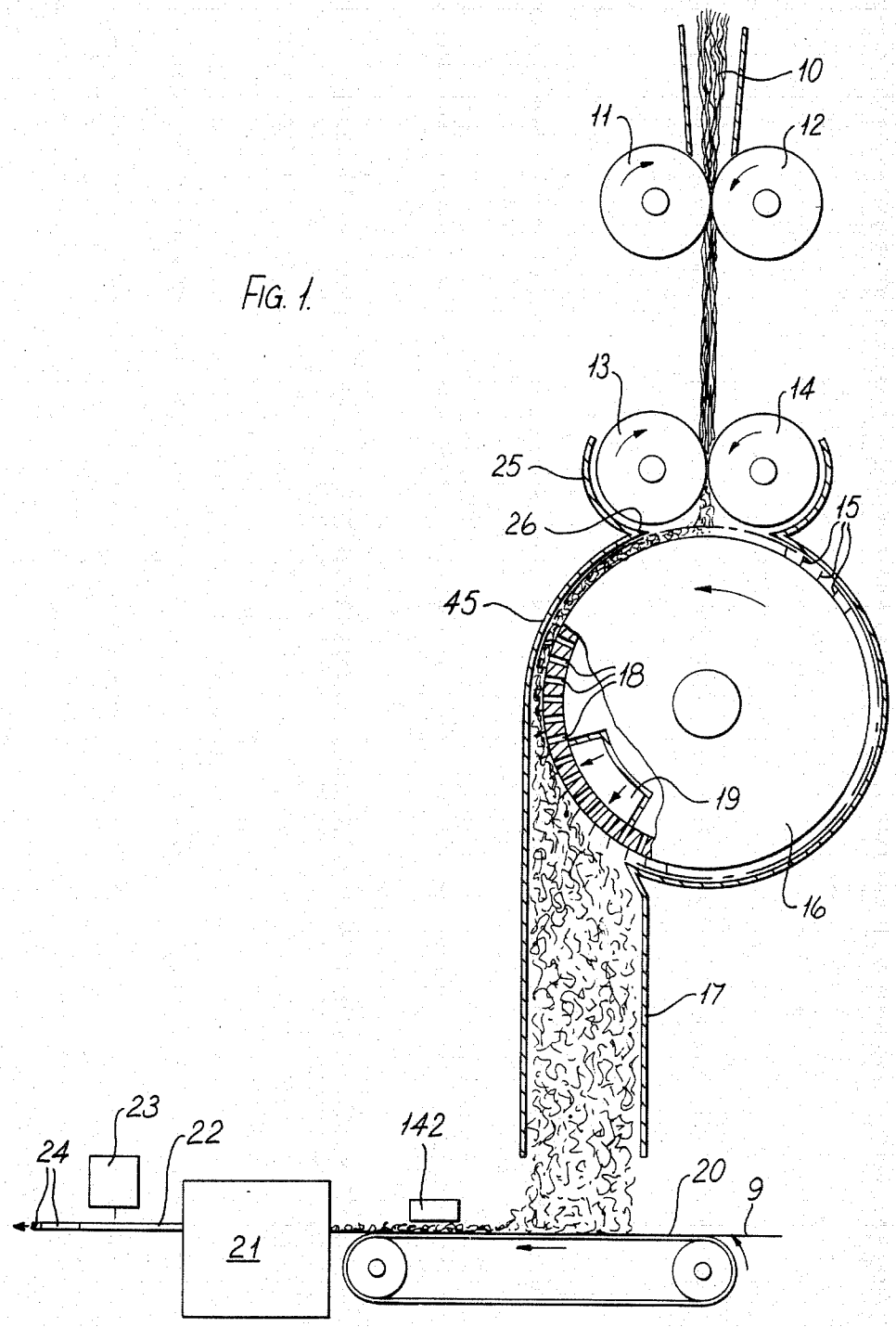
FIG. 1 is a side view of a machine for producing filter rod.

FIG. 1 shows crimped filter tow 10 being fed downwards between rollers 11 and 12 and then between rollers 13 and 14 which rotate at a higher speed than the rollers 11 and 12 so as to stretch the tow. If the tow 10 is uncrimped the rollers 11, 12 are unnecessary. On leaving the rollers 13 and 14, the tow is caught by pins 15 on the periphery of a roller 16 rotating at a high speed, e.g. approximately 5000 R.P.M. or generally within the range 1000 to 8000 R.P.M.

The pins 15 of the roller 16 engage the monofilaments of the filter tow and break them into portions of various lengths which are initially conveyed further by the roller 16 before being delivered into a downwardly extending duct 17. The periphery of the roller may, as shown, be formed with approximately radial passages 18 through which air is blown outwards from a manifold 19 to assist in removing the filaments from the roller; alternatively, air at atmospheric pressure may be admitted into the manifold 19 and may be displaced through the passages 18 by a centrifugal pumping action. In the upper region of the roller 16, there may be suction to help in pulling the fibers onto the roller.

On leaving the roller 16, the broken filaments are randomly orientated. They are deposited on a carrier stream 9 (e.g. of filamentary filler material) conveyed by a conveyor band 20 which delivers the carrier stream and filaments to a rod-forming device 21. Suction may be applied through the band 20 to locate the filaments and convey the stream. The rod-forming device 21 forms a continuous filter rod 22 which is then cut at regular intervals by a cutting device 23 to produce individual rods 24.

We have found by experiment that a pin roller is a particularly effective and reliable means of breaking up continuous monofilaments of filter tow so as to produce a stream of randomly orientated filaments. Our experiment was carried out with a typical crimped filter tow of cellulose acetate. Although the crimping is assumed to assist the pins in gripping the filaments so as to break them, we envisage that it will be possible to use filaments which are crimped less than is desirable in the case of conventional filter manufacture, and possibly not at all. Reduced crimping, or the elimination of crimping, would reduce the costs of the initial filter tow material.

The tow feed, including the rollers 11 to 14, may take various known forms. One example is described in United States Defensive Publications T 941011, which is referred to in its entirety. The tow feed may in general include means for "blooming" the tow pneumatically in any known manner. Also there may be means for applying plasticiser, e.g. in any known manner; alternatively, plasticiser may be blown out through the passages 18 or otherwise applied after the tow has reached the roller 16 and at least partially been broken. A basic tow feed arrangement which may be used is shown diagrammatically in U.S. Pat. No. 3,658,626; in this connection it should be noted that other details described in that U.S. patent and in the related U.S. Pat. No. 3,377,220 (apart from the tow chopping arrangement) may be employed in carrying out the present invention; for example, a non-wrapped filter rod may be produced in the manner described mainly in U.S. Pat. No. 3,377,220.

The rollers 11 to 14 shown in FIG. 1 (or one roller of each pair) may be axially fluted or may be rubber-coated so as to grip the tow or may be conventional so-called threaded rollers having circumferential grooves.

It should be noted that a curved wall 45 forming an extension of one wall of the duct 17 passes around the roller 16 and together with a curved wall 25 around the roller 13, forms a scraper 26 which helps to ensure that the broken filaments of tow continue on the roller 16, rather than passing round the roller 13. The wall 25 is mounted as close as possible to the roller 13 for that purpose, allowing only running clearance.

The tips of the pins 15 on the roller 16 are as close as possible to the surfaces of the rollers 13 and 14, again allowing just running clearance.

Figure 2:
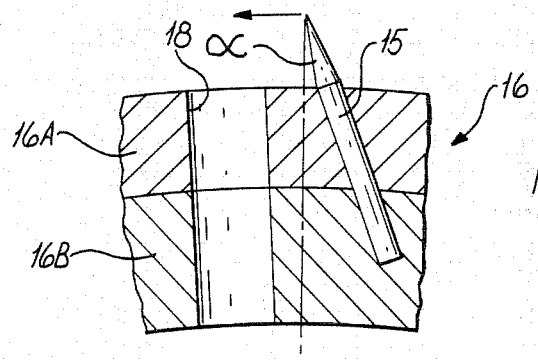
FIG. 2 is an enlarged section of a portion of a pin roller in a plane normal to the axis of the roller.

FIG. 2 is an enlarged section of part of the peripheral portion of the drum 16, showing one of the pins 15 and one of the radial passages 18. In particular, it shows that each of the pins 15 is forwardly inclined. Not only is the axis of the pin inclined to a radius of the roller, but the front face of the tapered outer end of the pin is preferably inclined to a radius at that point by an angle $\alpha$ which is preferably approximately 10 to 15 degrees but may generally be within the range 5 to 40 degrees. The passage 18 is shown radial, but it may instead be inclined at the same angle as the axis of the pins.

The roller itself may be of aluminium. Within a peripheral portion 16A of the roller 16 there is preferably a moulded sleeve 16B of plastics material in which the inner ends of the pins are encased as shown in FIG. 2.

Figure 3:
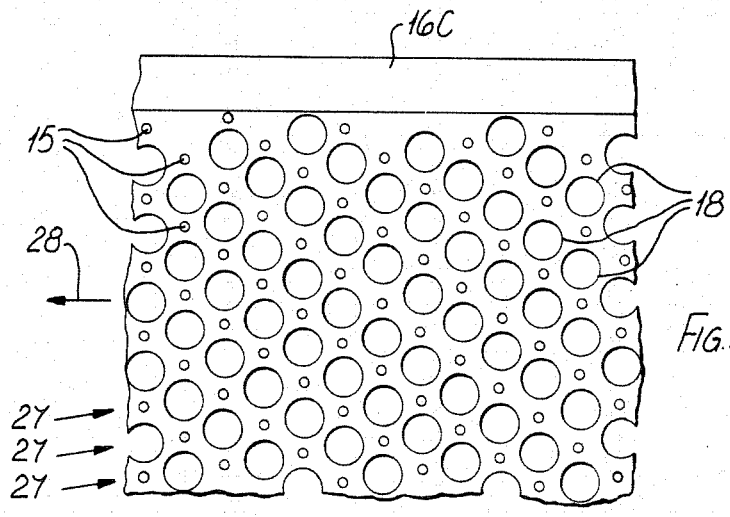
FIG. 3 is an elevation on an enlarged scale of part of the surface of the roller of FIG. 2.

FIG. 3 shows one preferred arrangement of the pins and air passages in the periphery of the roller 16. The pins lie in rows 27 which are inclined by a small angle. Furthermore, the pins within adjacent rows are staggered with respect to one another. This, coupled with the high speed of rotation of the roller, helps to ensure that no filament can move for any significant distance around the roller 16 without being engaged by one of the pins. On each side of the roller there is a flange 16C (only one of which is shown) which projects radially so that its surface is flush with the tips of the pins. The width of the roller 16 (between the flanges) may be approximately 200–250 mm. to accommodate the normal width of the spread stream of filter tow. Alternatively the tow stream fed to the roller 16 could be narrower so that the roller need not be as wide as this; the roller and stream could be as narrow as 25–100 mm.

As an idea of scale (but by way of example only) the roller 16 shown in FIG. 1 has a diameter of 120 mm. The pins 15 project 3 mm from the peripheral surface of the roller and are spaced apart in the rows 27 (FIG. 3) at intervals of 7 mm.

The average length of the broken filaments leaving the roller 16 will generally depend upon the speed of the roller 16 in relation to that of the tow 10, on the density of pins on the roller, on the strength of the monofilaments, and on the friction between the filaments on the one hand and the pins and roller surface on the other hand. In a test which we performed, using tow of average denier, e.g. total denier 40–50,000 and 3–4 dpf, the broken filaments were between about 6 mm and about 60 mm long.

Figure 4:
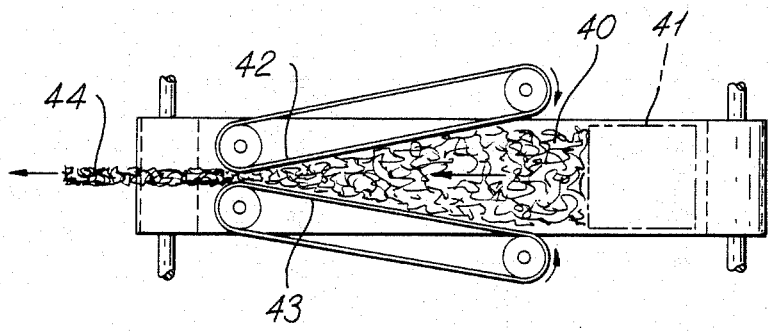
FIG. 4 is a plan view of a modification of the machine of FIG. 1.

FIG. 4 shows a conveyor band 40 onto which fibres are delivered over an area 41, and side bands 42 and 43 which converge while moving in the same direction as the band 40 so as to gather in the fibers. A narrow stream 44 of randomly orientated fibers is thus produced and is fed to a rod-forming device (not shown). In place of the converging bands 42 and 43, there may be converging fixed side walls. A U-shaped carrier stream may be conveyed by the band 40 between the bands 42, 43 or fixed side walls. Alternatively, a flat carrier stream could be conveyed, this being wrapped around the stream 44 downstream of the bands 42, 43 or side walls.

The band 40, and also the similar band 20 in FIG. 1, may be porous and suction may be transmitted through it from below so as to grip the fibers onto the band where appropriate. For example, in FIG. 4, the suction chamber may be tapered so that its sides correspond to the converging bands 42 and 43.

In the absence of converging bands 42 and 43, there may be converging air pressure manifolds, above the band 40 or below it, from which air jets are directed inwards to displace the fibers towards the center of the conveyor 40 as they move on the conveyor. Alternatively, other means may be provided for gathering in a relatively wide stream of fibers to produce a narrow stream such as can be compressed readily to the cross-section of a finished cigarette filter e.g. as described in U.S. Pat. No. 3,548,837.

Another possibility is that the broken fibers delivered by the roller 16 may be showered and formed into a narrow stream in the manner of a cigarette making machine, e.g. the Molins Mark 6, 8 or 9 machine, the Hauni Garant machine or the SASIB:SIGMA machine. Other possible ways of collecting the stream of fibers are as disclosed in British Patent Specification No. 2,048,968. If the fibers are sufficiently short, it might be possible to trim the stream (as practised in modern cigarette making machines) before delivering the stream to a rod-forming device.

Instead of gripping the broken fibers by the action of suction applied through it, the conveyor 20 shown in FIG. 1 (and conveyor 40 in FIG. 4) may be electrostatically charged to grip the fibres where necessary.

Figure 5:
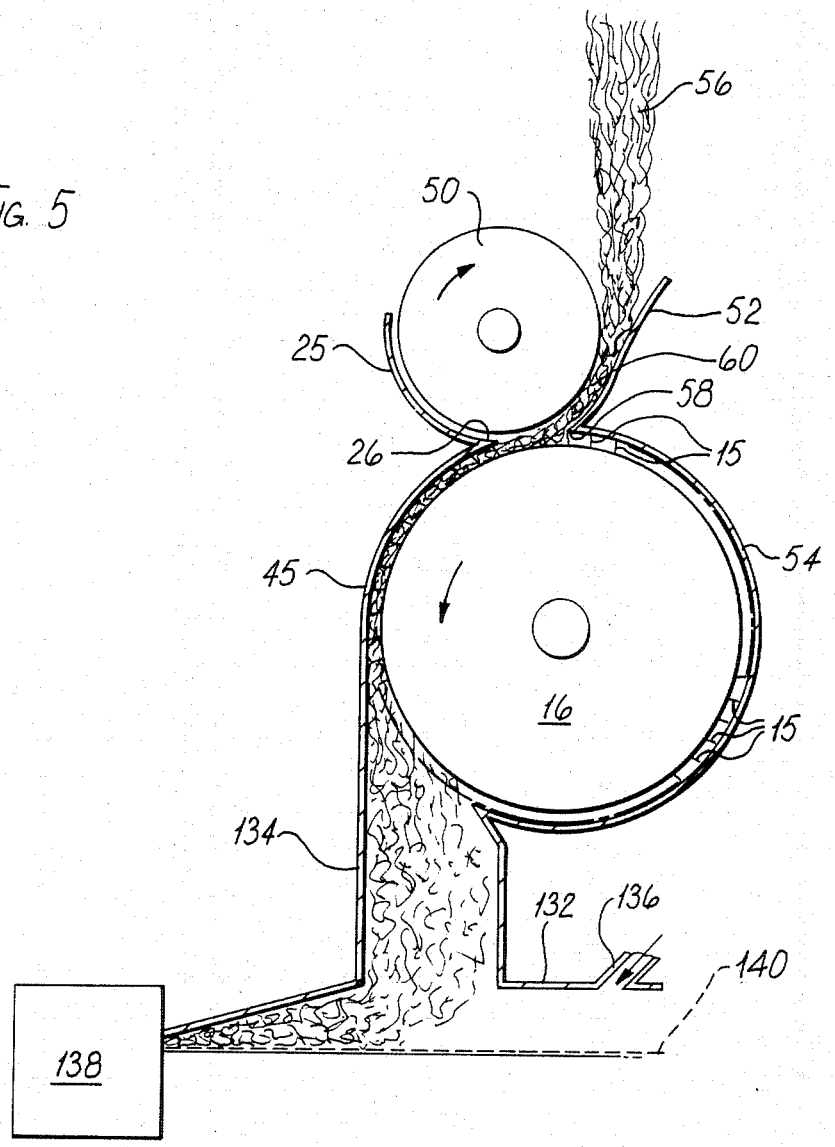
FIG. 5 is a side view of another modification of the machine of FIG. 1.

Another possibility is that the fibers leaving the roller 16 may enter through the side of a horizontally extending pipe through which air is blown to propel the fibers, e.g. directly into the rod-forming device. The air may be blown obliquely into the pipe so as to produce a vortex tending to roll the stream of fibers. This arrangement is indicated in FIG. 5, which shows a modified arrangement in which the rollers 11–14 of FIG. 1 are replaced by a single roller 50 placed in a similar position to the roller 13 and cooperating with an opposed guide 52 which is connected to a rear wall 54 surrounding the pin roller 16. Part of the guide 52 converges towards the roller 50 and serves to guide the tow stream 56 onto the roller. Downstream of this part, adjacent its connection 58 to the wall 54, the guide 52 follows the periphery of the roller 50 and defines a lead-in channel 60 for the pin roller 16. As compared with the FIG. 1 arrangement the tow is more restricted at the position of initial contact with the pin roller 16; this may have the advantage that shorter fibers can be produced. As with the FIG. 1 arrangement the clearance allowed for the pins 15 (by the walls 45, 54 and roller 50) is minimal. A substantially horizontal pipe 132 extends below the chute 134 and includes oblique air inlets 136. The stream thus produced is delivered to a rod-making unit 138 on a carrier stream 140 of suitable filter material.

Figure 6:
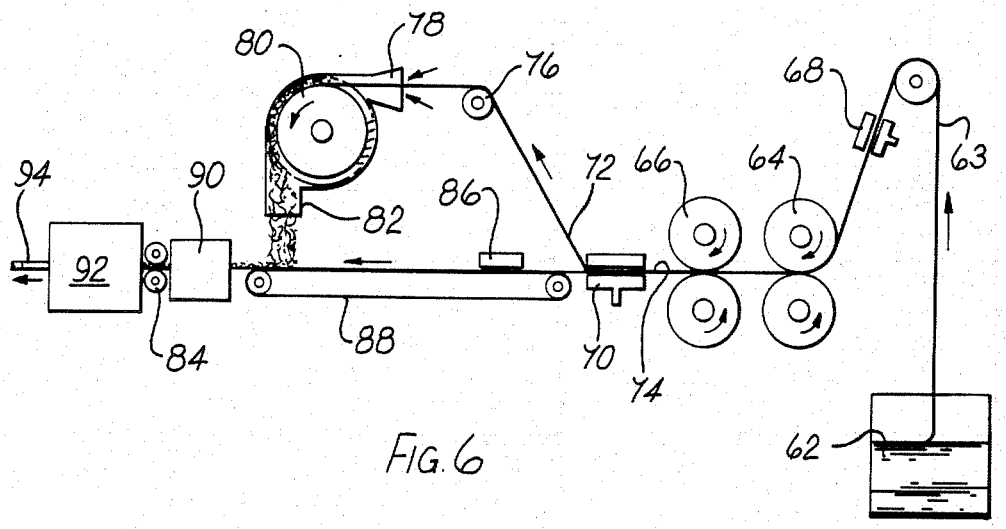
FIG. 6 is a side view of another machine for producing filter rod.

FIG. 6 shows a bale 62 of crimped filter tow from which a continuous stream 63 is drawn by pretension rollers 64 and stretching rollers 66. A banding jet 68 is provided upstream of the rollers 64 to spread the tow. Downstream of the rollers 66 a further banding jet or jets 70 are arranged to split the tow into two streams 72, 74. This may be achieved by directing the jet or jets 70 so that the stream 63 is laterally split, i.e. different parts of its width are directed on different paths. The main stream 72, which preferably comprises at least 70% of the tow in the stream 63 is directed upwards over a roller 76 and into a funnel-shaped transport jet 78 into which air is blown to convey the tow onto the periphery of a pin roller 80. The transport jet 78 may be similar to that disclosed in British Patent Specification No. 1,588,506 or in U.S. Pat. No. 3,106,945. The pin roller 80 acts on the tow stream 72 and produces a stream of broken fibers to a chute 82 in a manner similar to the pin roller 16 of FIG. 1.

The stream 74 comprising a part of the stream 63 after splitting by the banding jets 70 is conveyed forward (by downstream rollers 84) in substantial alignment with the stream 63 and passes directly beneath the chute 82. Additional banding jets 86, acting on the stream 74 may be provided for controlling its width prior to passage beneath the chute 82. The arrangement is such that the shower of broken fibers descending from the chute 82 falls on the banded tow stream 74 which subsequently acts as a carrier for those fibers. A conveyor band 88 could be provided to support the stream 74.

After the fibers from the pin roller 80 have been showered onto the carrier stream 74 both the fibers and the stream are passed through a plasticising chamber 90. Subsequently the plasticised stream and fibers are passed to a filter rod making unit 92 which forms filter rods 94. In the filter rod making unit 92 continuous filter rod is formed, which my be wrapped or unwrapped, as before. The rod shaping means in the unit 92 may be such that the carrier stream 74 is wrapped around the fibers rather in the manner that the paper wrapper is wrapped around a filler stream in a conventional rod forming unit. The rod 94 may therefore comprise a central core of broken filaments from the stream 72 encased in an annular sheath including the stream 74.

Figure 7:
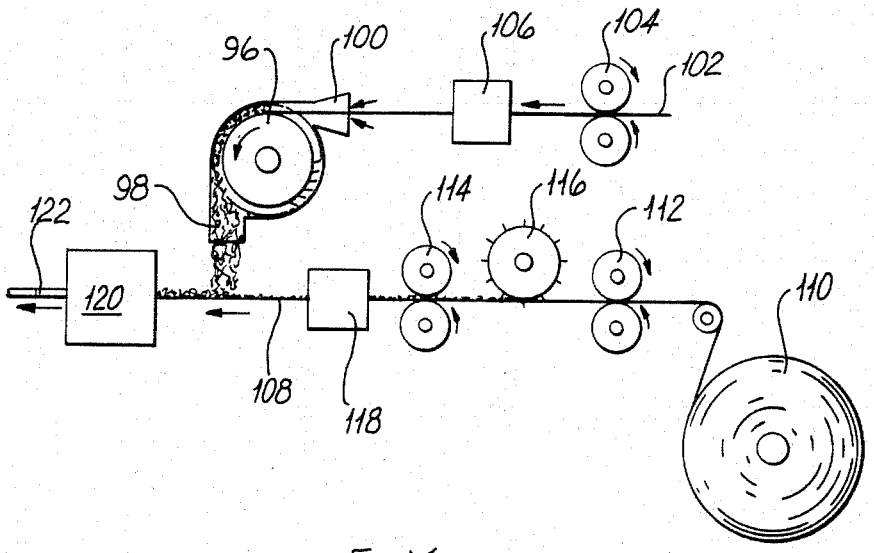
FIG. 7 is a side view of a further machine for producing filter rod.

FIG. 7 shows another machine for producing filter rod, including a pin roller 96 and chute 98 which are similar to the pin roller 80 and chute 82 of the machine of FIG. 6. A transport jet 100, which may be similar to the jet 78 of FIG. 6, is also provided. A tow stream 102 for delivery to the transport jet 100 is conveyed by rollers 104 from a tow bale (not shown). The rollers 104 could correspond to the rollers 66 of FIG. 6. The stream 102 passes through a plasticising chamber 106 before reaching the transport jet 100.

The broken fibres issuing from the chute 98 fall onto a carrier stream 108 comprising fibrillated sheet filter material. A continuous web of the sheet filter material is withdrawn from a reel 110 by rollers 112 and 114, between which the tension in the web is controlled. A fibrillating roller 116, preferably rotating at relatively high speed, makes a series of discontinuous slits in the web to form numerous substantially parallel fibers.

The roller 116 may be a pin roller substantially similar to the pin roller 16. Other ways of fibrillating a web of material are disclosed in British Patent Specifications Nos. 1,073,741, 1,244,982, 1,298,561, 1,421,324, 1,421,325, and 1,440,111, and in U.S. Pat. Nos. 3,474,611 and 3,675,541.

After fibrillation the stream 108 passes through a plasticising chamber 118 and beneath the chute 98 from which it receives the showered fibers from the stream 102. Subsequently the stream 108 and conveyed fibers are formed into a continuous rod in a rod making unit 120, which may be similar to the unit 92, and cut to produce filter rods 122.

The filter material of the reel 110 may be substantially similar to that of the stream 102 or may be different. Thus both streams 102 and 108 may be cellulose acetate, the stream 102 normally being in fibrous tow form and the stream 108 being initially in sheet form. However, one or both streams 102, 108 could be of alternative plastics filtering material, e.g. polypropylene, in which case plasticising is normally unnecessary. Where plasticising is necessary this could be carried out downstream of the position where the broken fibers are fed onto the stream 108, i.e. in a similar position to the chamber 90 of FIG. 6. Similarly, in the FIG. 6 machine, the chamber 90 could be replaced with separate devices acting on the respective streams 72, 74 or even with a device acting upstream of the splitting banding jets 70. Even where plasticising would normally be necessary on materials of the kind used for both the carrier and the broken fibers such plasticising may not be necessary for either the carrier or the filler since sufficient plasticiser to create a stable rod or otherwise modify the filter material could be supplied either to said carrier or said filler. Possibly some migration of plasticiser may take place within the stream before final curing.

The plasticising chambers 90, 106, 118 could be substantially similar to conventional plasticising chambers, in which plasticiser is usually sprayed, e.g. as used on the AMCEL 103 tow unit, but could be of other forms. For example, the plasticiser may be foamed for application to the tow or other fibers substantially as a stream of foam. This could be particularly useful for preserving or creating coherence in a stream of broken fibers.

In the FIG. 7 arrangement an additional treatment station may be provided to produce crimp in the fibrillated web. This station may be located at or adjacent the chamber 118 and may include means for treating opposite sides of the web in different ways, e.g. with different fluid additives or amounts thereof, so that the filaments produced by fibrillation become crimped. Plasticising, if necessary, could then take place downstream of this additional treatment station, and could be performed after showering from the chute 98 has taken place.

The carrier stream 108 could comprise a conventional tow stream. The reel 110 would be replaced by a tow bale and the tow bloomed in a conventional manner. The filter material in the tow stream 102 may be different from that in the stream 108.

Figure 8:
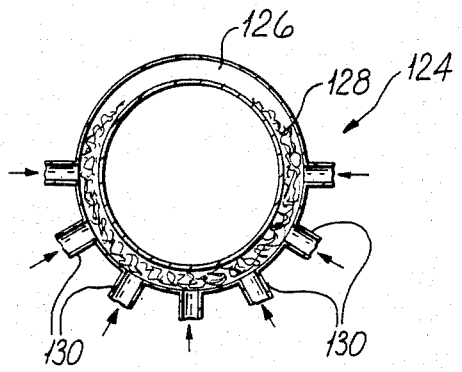
FIG. 8 is an enlarged sectional view of a modification of the machine of FIG. 6 or FIG. 7.

FIG. 8 shows in cross-sectional view a banding jet 124 comprising an annular passage 126 along which a tow stream 128 may be conveyed while subjected to the action of banding air streams, introduced for example through ports 130. The arrangement is such that the stream 128 is spread around the passage 126 so that it assumes a U-shape. The banding jet 124 could comprise a progressive change in shape from a conventional flat configuration to that shown in the drawing, so that the stream 128 is initially spread out in a substantially flat plane. Having obtained a U-shaped tow stream 128 this can advantageously be used as a carrier stream for broken tow fibers showered onto it, (or otherwise delivered onto it). For example, a banding jet 124 could be located downstream of the jet 86 in FIG. 6 to act on the stream 74. Similarly a guide similar to the banding jet 124 could be provided to preshape appropriately the stream 108 in FIG. 7.

In order to improve the filtering characteristics of the completed filters, an additional filtering material may be added to the stream of randomly orientated fibers used to produce the filter rod. For example, particles of carbon or other filtering material may be sprinkled on to the stream of fibers, by a unit 142 as indicated in FIG. 1 for example.

Another possibility is that broken fibers of a different material may be included with the cellulose acetate fibers. For example, the different material may comprise fibers of plastics material or of carbon, carbon based or carbon carrying material, the carbon in each case being preferably activated. Such material may be fed as continuous fibers and may be broken-up randomly by being fed to the roller 16 together with the cellulose acetate fibers, or by being fed to a separate roller corresponding to the roller 16. In either case, the fibers of additional material are preferably broken up randomly and are fed in random orientations into or together with the cellulose acetate fibers.

Figure 9:
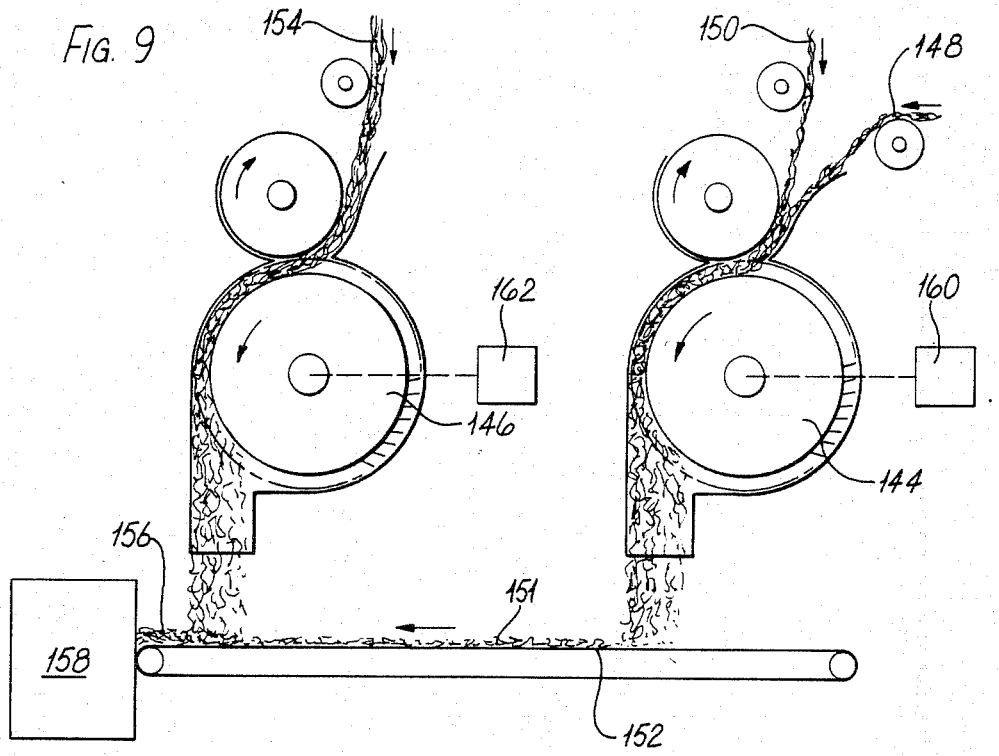
FIG. 9 is a side view of a still further machine for producing filter rod.

An arrangement including two pin rollers 144, 146, each similar to the roller 16, is shown in FIG. 9. A first stream 148 of fibrous filtering material is fed to the roller 144 together with a second stream 150 of a different fibrous filtering material, so that a mixture of broken fibers from the two streams is deposited on a band 152 below the roller to form a carrier stream 151. The band 152 passes beneath the other pin roller 146 to which a third stream 154 of a different fibrous filtering material is supplied, so that at its downstream end the band 152 carries a stream 156 of broken fibers of the three different filtering materials, for delivery to a rod-making unit 158. The band 152 may be supplied with suction or other means to ensure positive conveyance of the stream.

In the machine shown in FIG. 9 driving means 160, 162 for the respective pin rollers 144, 146 is indicated diagrammatically. This may take any convenient form and may, for example, comprise separately controlled motors or chain and sprocket connections to a main motor for the rod forming unit 158. It will be understood that drive for the rollers 16 (FIGS. 1, 5), 80 (FIG. 6), and 96 (FIG. 7) may be derived in a similar way.

As a means of controlling the filter manufacturing operation, the filter rod 22 (FIG. 1) or the stream of fibers used to form this or other filter rods of the invention may be continuously monitored as to its weight, for example by means of a nucleonic scanning device. In response to a signal from the nucleonic or other weight monitoring device, the rate at which the continuous cellulose acetate fibers is fed towards the roller 16 may be automatically controlled so as to maintain the weight per unit length of the completed filter rod substantially constant. Alternatively, or additionally, where trimming of the stream of broken fibers is provided the signal may be similarly used to control the trimming device. Particularly where impregnation of fluid additive has already taken place, however, this may result in rapid fouling of conventional trimming devices; an acceptable alternative would be to use a high speed air stream or other trimming device which does not directly contact the stream.

The material from which the broken fibers are produced need not be cellulose acetate tow. Thus, any of the illustrated arrangements could be supplied with alternative material capable of being fed as a substantially coherent stream but separable into fibers or particles. For example, any of the streams 10, 56, 63, 102, 148, 150, 154 could be fibrillated webs of cellulose acetate or other suitable material. Another such alternative material is foamed sheet material, e.g. foamed sheet material, e.g. foamed cellulose acetate or, more generally foamed or filled material having filtering properties, e.g. polypropylene. Thus polypropylene or other plastics material in suitable form (e.g. fibrous, possibly produced by fibrillating basic sheet material which might be foamed or filled) or carbon fibers might be used instead of (or in addition to) cellulose acetate tow for production of broken fibers or particles. A suitable material is a filled polypropylene marketed by the Shell Chemical Company under the trade mark CARIFIL. The action of a pin roller such as the roller 16 on such a material is to produce randomly orientated particles of varying length in a similar manner to that produced with conventional tow. The stream 102 could be supplied from a reel similar to the reel 110 and could comprise a flattened foam web of suitable material.

We claim:

1. A method of producing filter rod, comprising the steps of conveying a substantially continuous first stream of long filaments, breaking the filaments of said first stream into relatively shorter filaments of irregular lengths by applying tension to the filaments, conveying a carrier stream of filaments, depositing the broken filaments from said first stream on the carrier stream so that the broken filaments are arranged in substantially random orientations on the carrier stream with the carrier stream supporting and conveying said broken shorter filaments so as to form a combined stream having separate first and second regions, said first region containing predominantly said carrier stream and said second region containing predominantly said broken filaments, and forming said combined stream into continuous filter rod.

2. Apparatus for producing filler material, comprising means for conveying a substantially continuous first stream of long filaments, means for engaging said first stream and for breaking the filaments into relatively shorter filaments of irregular lengths, said engaging means including a conveyor having a surface adapted to engage said filaments and means for driving the conveyor such that the filaments of the stream are engaged by the surface of the conveyor and broken into irregular lengths by tension applied to the filaments, means for conveying a carrier stream of filaments, and means for combining the broken filaments from said first stream with the carrier stream to form a combined stream with said carrier stream supporting and conveying said broken filaments during further conveyance of said combined stream, said combining means including means for projecting said broken filaments onto said carrier stream in substantially random orientations and in such a way that said combined stream has separate first and second regions, said first region containing predominantly said carrier stream and said second region containing predominantly said broken filaments and means for forming a continuous filter rod from the combined stream.

3. Apparatus according to claim 1, wherein at least one of the means for conveying the first stream and the means for conveying the carrier stream includes means for opening a filter tow.

4. Apparatus according to claim 1, wherein at least one of the means for conveying the first stream and the means for conveying the carrier stream includes means for fibrillating a continuous web of filter material.

5. Apparatus according to claim 1, including means for conveying a common stream of filamentary material and for splitting said stream to form said first stream and said carrier stream.

6. Apparatus according to claim 5, wherein the splitting means includes means for pneumatically separating said common stream.

7. Apparatus according to claim 1, wherein said means for conveying the carrier stream includes means for conveying a substantially continuous stream, means for engaging the filaments of the stream and for breaking them into irregular lengths, and means for conveying the carrier stream as broken filaments.

8. Apparatus according to claim 1 or claim 7, wherein at least one of said means for conveying the first stream or said means for conveying the carrier stream includes means for receiving and conveying two streams of different filler material.

9. Apparatus according to claim 1, wherein the broken filaments are showered onto the carrier stream.

10. Apparatus according to claim 11, including pneumatic means for directing filaments onto the carrier stream.

11. Apparatus according to claim 1, including means for applying a solid or fluid additive to at least one of said streams.

12. Apparatus according to claim 1, wherein said conveyor has sharp projections for engaging the filaments.

13. Apparatus according to claim 12, wherein apertures are provided in said conveyor surface, including means for blowing air through the apertures to propel filaments away from the surface.

14. Apparatus according to claim 13, including means for applying a treating fluid to the filaments through said apertures.

15. Apparatus according to claim 2, including means for shaping the carrier stream so as to confine at least partially the broken filaments.

16. Apparatus according to claim 15, wherein the shaping means comprises pneumatic guide means.

17. Apparatus according to claim 16, wherein the pneumatic guide means is arranged so that the carrier stream is progressively wrapped around the broken filaments.

18. Apparatus according to claim 1, wherein said conveyor is arranged such that filaments of said first stream engaged by said surface are moved substantially in a longitudinal direction by said surface.

19. Apparatus according to claim 1, wherein said conveying means for said first stream includes means for controlling the speed of the first stream upstream of said conveyor.

20. Apparatus for producing filter rod, comprising first means for producing a filler stream of relatively short filaments from a first stream of filter material, said first means comprising means for feeding relatively long filaments of filter material and means for engaging the filaments and breaking them into shorter filaments of irregular lengths, second means for conveying a carrier stream of relatively long filaments of filter material, means for depositing the filler stream on the carrier stream so that the short filaments of the filler stream are arranged in substantially random orientations on the carrier stream with said carrier stream supporting and conveying said broken shorter filaments so as to form a combined stream having separate first and second regions, said first region containing predominantly said carrier stream and said second region containing predominantly said broken filaments, and means for forming continuous filter rod from the combined filler and carrier streams.

21. Apparatus according to claim 20, including means for diverting part of the first stream to form the carrier stream.

22. Apparatus according to claim 20, including means for fibrillating a web of filter material to form said carrier stream.

23. Apparatus according to claim 22, including means for blooming a filter tow to form said first stream of filter material.

24. Apparatus according to claim 22 or 23, including means for treating at least one of said streams with an additive prior to combining said streams.

* * * * *